United States Patent [19]

Mayall

[11] 4,105,377

[45] Aug. 8, 1978

[54] HYDRAULIC ROLLER MOTOR

[76] Inventor: William Mayall, 17 Norfolk Ct., Chanctonbury Rd., Rustington, Sussex, England

[21] Appl. No.: 514,834

[22] Filed: Oct. 15, 1974

[51] Int. Cl.[2] ..... F01C 1/24; F03C 3/00; F01C 21/08; E21B 3/12

[52] U.S. Cl. ..... 418/173; 418/225; 175/106; 175/107

[58] Field of Search ..... 418/173, 225, 268; 175/107, 106

[56] References Cited

U.S. PATENT DOCUMENTS

| | | | |
|---|---|---|---|
| 2,669 | 6/1842 | Beale | 418/225 |
| 345,885 | 7/1886 | Colebrook | 418/225 |
| 945,209 | 1/1910 | Avery | 175/107 |
| 1,466,904 | 9/1923 | Jackson | 418/225 |
| 1,790,460 | 1/1931 | Capeliuschnicoff | 175/107 |
| 2,002,387 | 5/1935 | Bannister | 175/107 |
| 2,473,537 | 6/1949 | McDonald | 175/107 |
| 2,586,964 | 2/1952 | Kraissl | 418/225 |
| 2,660,402 | 11/1953 | Devine et al. | 175/107 |
| 2,937,008 | 5/1960 | Whittle | 175/107 |
| 3,076,514 | 2/1963 | Garrison | 175/107 |
| 3,136,304 | 6/1964 | Tauscher | 418/225 |
| 3,169,485 | 2/1965 | Sadler et al. | 418/225 |

FOREIGN PATENT DOCUMENTS

| | | | |
|---|---|---|---|
| 614,712 | 6/1961 | Italy | 418/225 |
| 600,019 | 11/1959 | Italy | 418/225 |
| 4,143 of | 1885 | United Kingdom | 418/225 |

*Primary Examiner*—John J. Vrablik

[57] ABSTRACT

A positive displacement, constant speed, pressure sealing, wear compensating, hydraulic motor for driving a rock drill, comprising an exernally cylindrical rotor mounted for axial rotation in an internally cylindrical housing and connectible to a drill bit to transmit driving torque thereto, a plurality of driving members in the form of cylindrical rollers mounted in respective axially extending recesses in the cylindrical surface of said rotor, the rollers being floated by fluid flow and pressure only and without the aid of mechanical springs, into sealing engagement with said housing, and at least two circumferentially extending recesses in the cylindrical wall of said housing adapted to receive said dri ing members in succession during rotation of the rotor; each said recess having circumferentially spaced inlet and outlet means for drilling mud for impingement on said driving members to drive said rotor.

16 Claims, 6 Drawing Figures

SECTION II II

HYDRAULIC ROLLER MOTOR

This invention concerns a self-sealing wear compensating hydraulic rock drill for penetrating the earth's crust to great depths, for instance to reach oil or gas-bearing strata. Commonly, such drilling is accomplished by the use of a drilling rig adapted to rotate a suitable drill bit by rotation of a so-called drill-string of coupled pipes that extend from the rig on the surface down to the drill bit which is fixed at the bottom of the lower-most pipe of the drill-string. Chips and rock particles produced by the action of the rotating bit on the borehole bottom are flushed to the surface via the annular space between the drill-string and the borehole wall by a stream of liquid that is conveyed to the bottom of the borehole through the connected pipes consituting the drill-string. This liquid, usually called mud, also serves the purpose of cooling the drill bit.

The torque needed to rotate the drill bit under heavy drill collar weight is substantial and is commonly transmitted to the drill bit through the drill-string from the rig on the surface; the energy stored in the drill string "wraps" or "wind-up" when transmitting this torque is therefore considerable, especially when drilling at great depths, giving rise to difficulties when the bit penetrates discontinuities that cause fluctuations in the torque requirements of the bit. Moreover, the transmission of the required torque from the rig to the bit requires the drill-string pipes to be of substantial wall thickness and rigidity and thus both heavy and expensive costing probably between $100,000 to $250,000. This rotating drill-string is subject to rapid wear.

It has be recognised and accepted that many of the disadvantages presently embodied in standard oil well drilling procedure might be avoided by generating the required torque for rotating the drill bit by means disposed adjacent the drill bit and powered by energy conducted to such means. The art is replete with proposals for turbodrill constructions but, so far as I am aware, no hydraulic drilling tool yet proposed has demonstrated an ability to compete in practical circumstances with a drill of the conventional drill string rotation construction mentioned above.

Viewed from one aspect the present invention provides a rotary positive displacement motor suitable to drive a rock drill, comprising an externally cylindrical rotor mounted for axial rotation in an internally cylindrical housing and connectible to a drill bit to transmit driving torque thereto, a plurality of driving members in the form of cylindrical rollers mounted in respective axially extending slots in the cylindrical surface of said rotor and outwardly forced into sealing engagement with said housing by mud flow and pressure only and at least one circumferentially extending recess in the cylindrical wall of said housing adapted to receive said driving members in succession during rotation of the rotor, the or each said recess having circumferentially spaced inlet and exhaust port means for drilling mud for impingement on said driving members to drive said rotor.

Such a motor may be so designed, e.g. in the size and number of the said driving members and housing recesses, as to achieve rotation of the rotor at a relatively slow speed in the desired region of 25 to 250 rpm whilst at the same time a sufficiently high torque is transmitted to the drill bit because substantially all of the energy abstracted from the mud is passed through the rotors to the bit.

The said rotor housing may conceivably form a fixed part of an outer casing of the motor connectible to the bottom of a drill-string and thus constitute a stator. Such an arrangement has the disadvantage of generating considerable torque and then using this torque to "wind up" the drill-string instead of directing said torque into the rock bit to drill hole. In a preferred form of the invention, therefore, the said rotor housing is mounted for axial rotation in an outer casing of the motor and is positively connected to the rotor by suitable gearing arranged to permit rotation of the cylindrical rotor and the profiled housing in clockwise and anti-clockwise rotation and this facilitates the rotation of the drill bit at a correct speed.

Each of the said roller driving members slidably extend over the length of the cylindrical rotor and each roller under fluid flow and pressure is forced to take up its respective drive, sealing and wear-compensating position between the cylindrical axially recessed rotor and the internally axially recessed and profiled ported housing.

It is a feature of the invention that each roller driving member should in its retracted position have probably 1 millimeter clearance in a lateral or circumferential sense in its slot in the rotor's cylindrical body so that inlet pressurised mud has access to the side and back or radially under-belly of the roller driving member to positively urge it outwardly into sealing and wear-compensating engagement with the leading side walls of the slot in the cylindrical rotor and with the largest concentric recesses in the rotor housing as the driving members traverse such recesses so as to maximise the pressure differential across the driving member during such traverse.

In a presently preferred embodiment three recesses are provided 120° apart and the rotor carries 12 driving members. The inlet ports which revolve clockwise with the housing are arranged at regular intervals down the length of the internally profiled housing to feed fluid via ports positioned in the motor's outer case and profiled housing into the motor. The outlet or exhaust ports which revolve with the housing pass fluid, which having caused the motor to revolve has suffered a pressure drop, through the internal profiled housing into a number of longitudinal spaced exhaust ports and these are directly connected via longitudinal passages and other members to the inside diameter of the drill shaft and so to the drill bit.

Embodiments of the invention will now be described by way of example and with reference to FIGS. 1,2,3,4,5,6.

Figure 1:
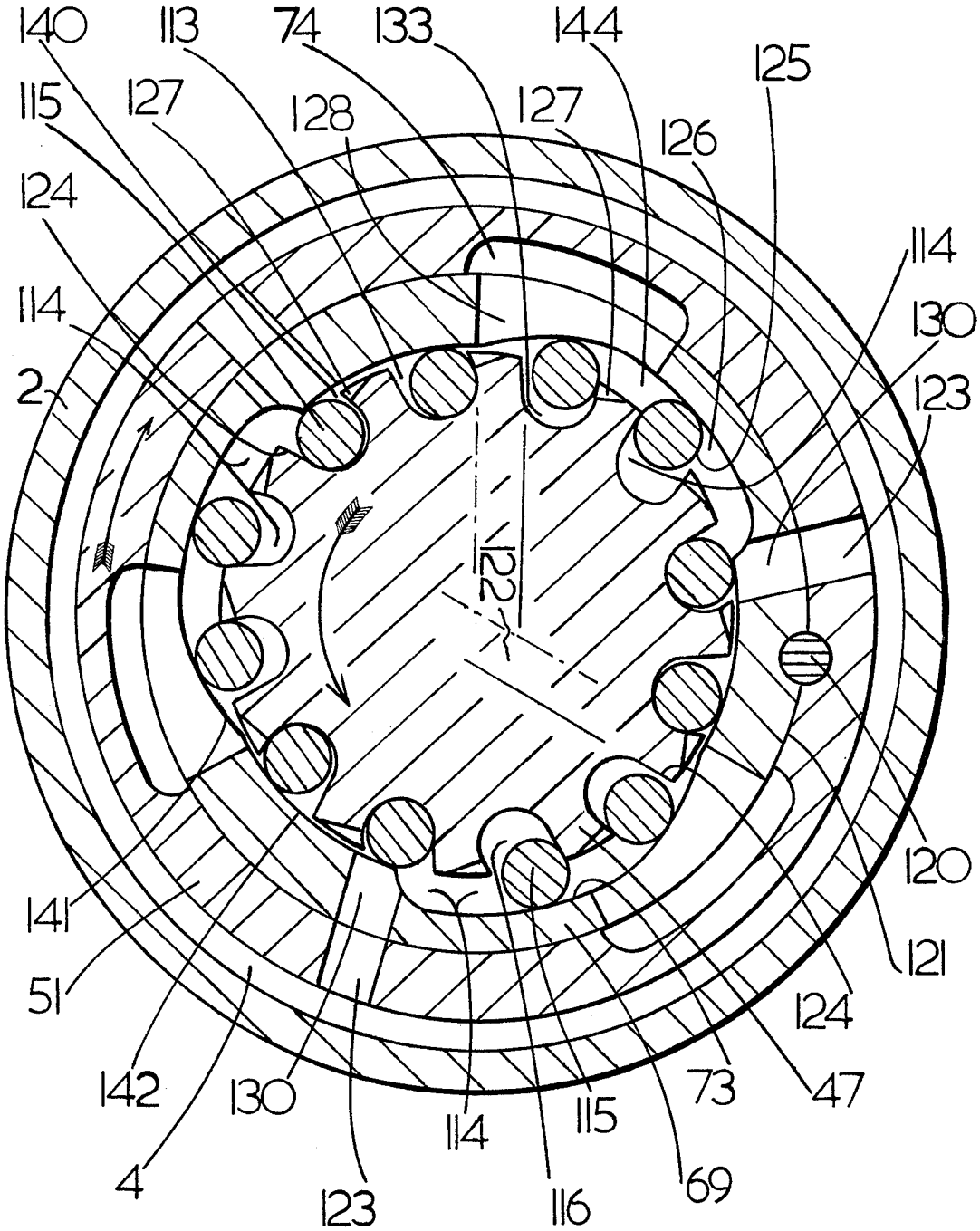
FIG. 1 is a sectioned view of the motor at II II of FIG. 4 showing the driving rollers in respective position between the cylindrical rotor with its fluid directing recesses which are preferably positioned as shown in line with the incoming inlet port fluid and profiled rotor housing together with inlet and exhaust ports and longitudinal fluid connections to the drill shaft.
Figure 2:
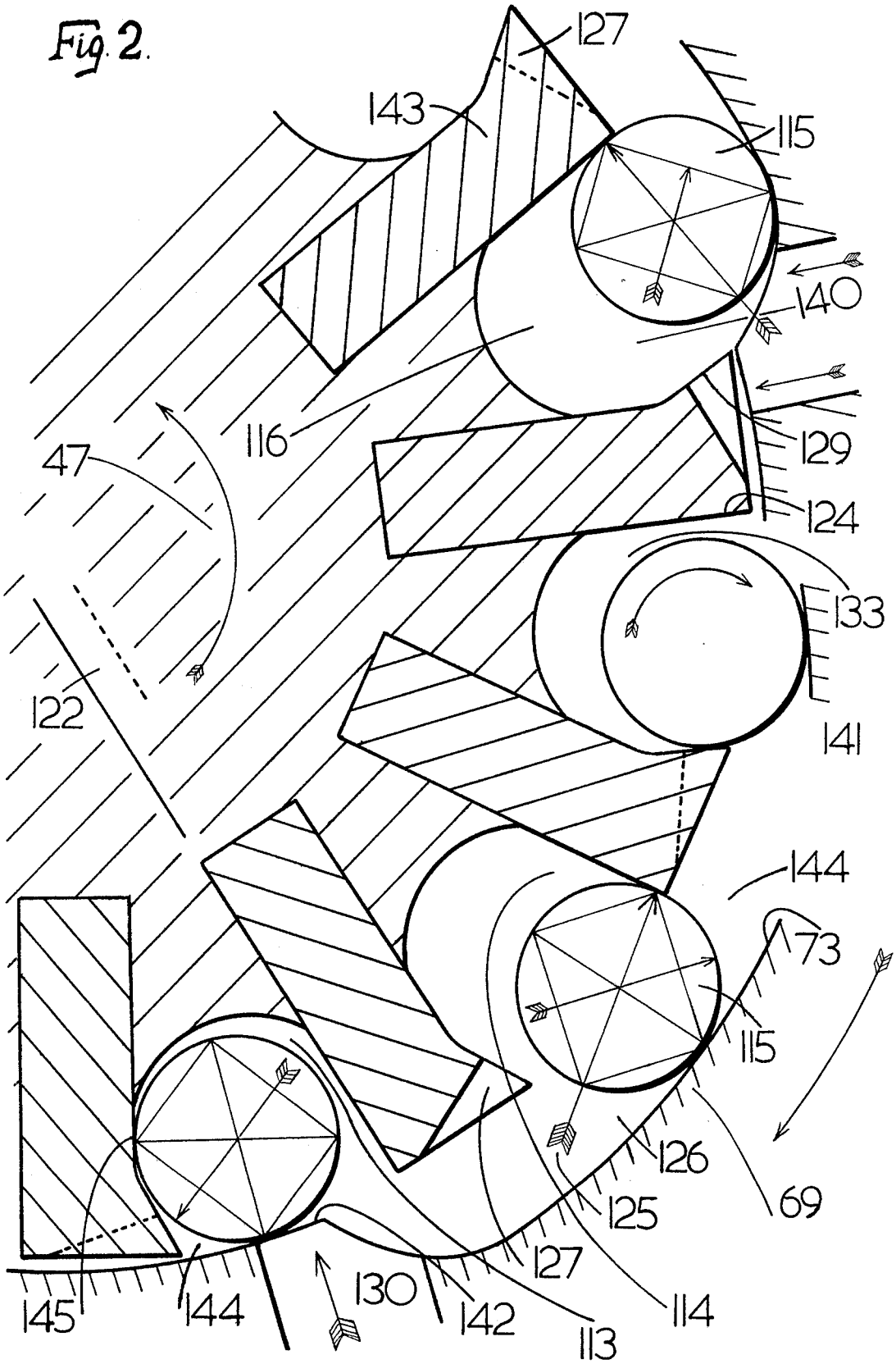
FIG. 2 shows an enlarged split section of rollers and external rotor.
Figure 3:
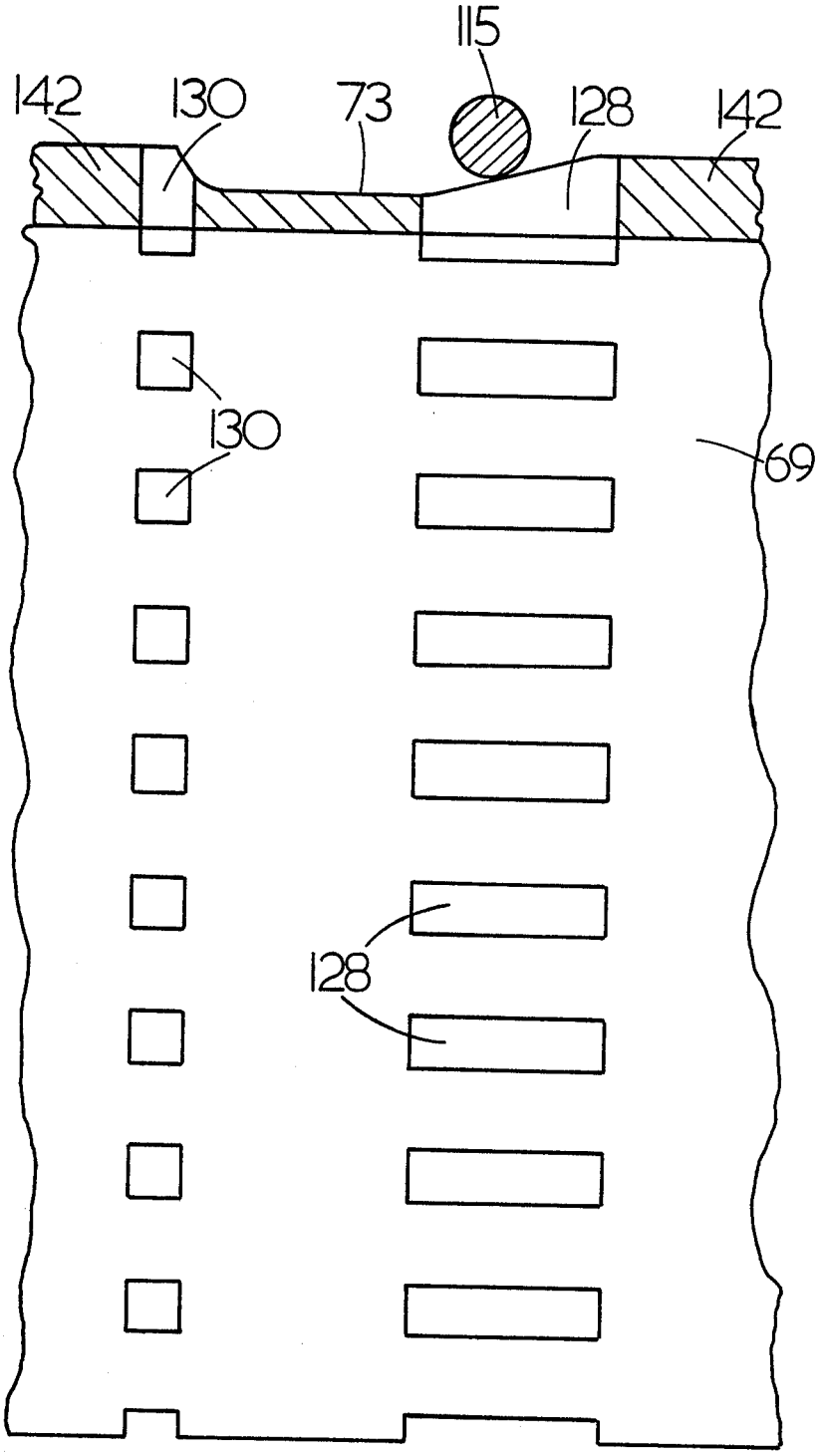
FIG. 3 is a "flattened" sketch of the motor's outer cylindrical surface showing the inlet and exhaust ports and also port relation to the internal recessed and profiled contour of the motor housing.
Figure 4:
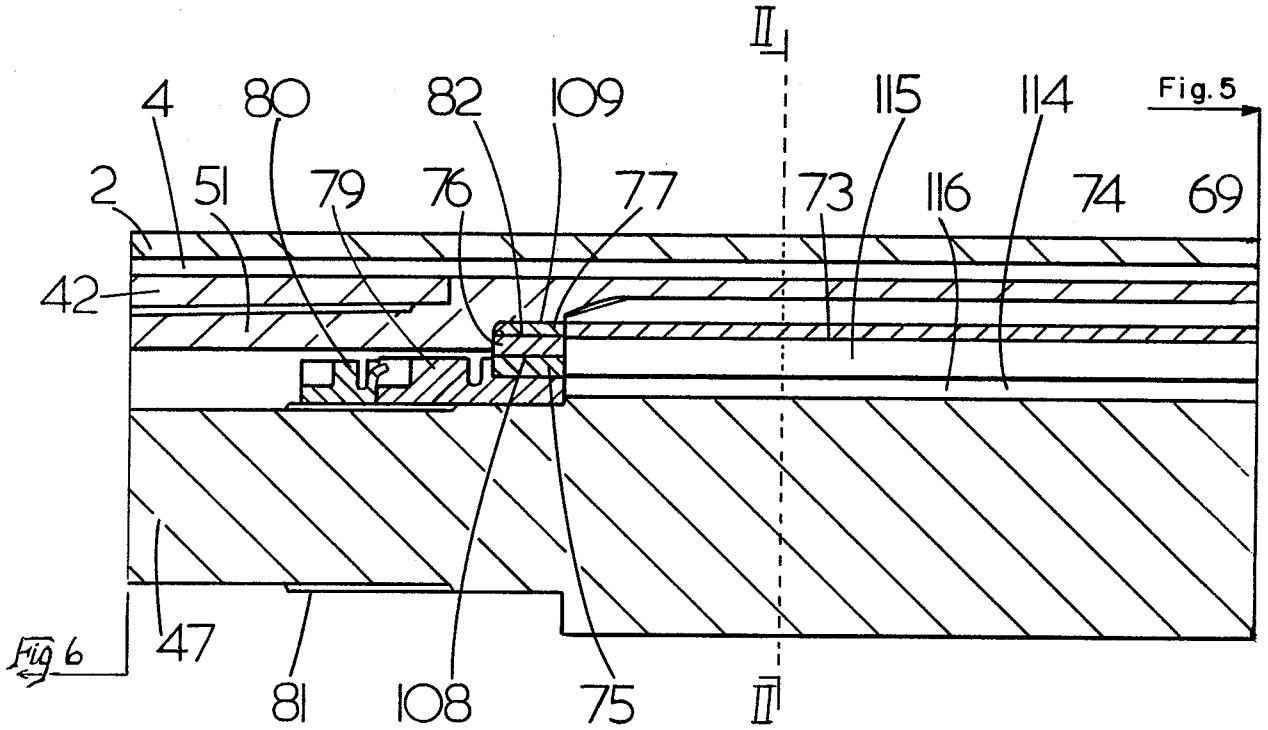
FIG. 4 is a quarter section of the external and internal cylindrical rotors and bearing means.
Figure 5:
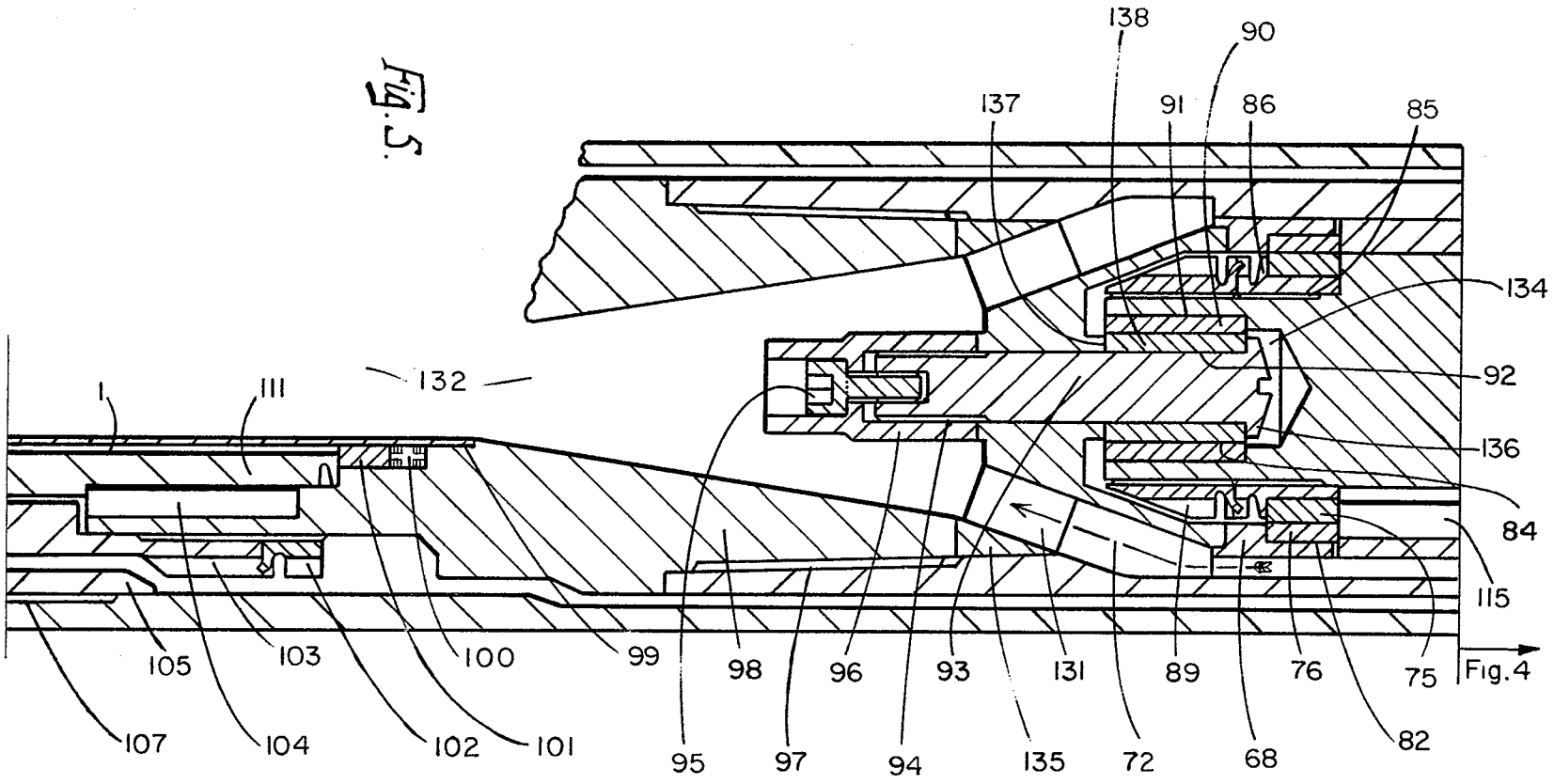
FIG. 5 is a half section continuation of FIG. 4 and shows the motor and bottom end bearing means and connects to the drill shaft.

Referring to FIGS. 1,2, and 3, and reference cross sections 4, and 5, the outer motor body 51 embodies tungsten carbide ring bearings 76 which has ring member 77 shrink fitted at 82 onto its outside diameter, member 77 embodying 76 being likewise shrink fitted at 109 into housing 51, which member 51 embodies in its internal profile exhaust recess 74, and also inlet ports 123 and 130, see FIG. 1, which allows mud flow from 4 to pass into the space between rotor member 47 and the internal housing member 69 to pressurize the rollers and cause rotation. The cylindrical outside diameter of the internal housing 69 is also shrink fitted at 121 into motor outer case 51 being located in radial position by key 120. External rotor 47 is screwed at 81 to accept and locate tungsten carbide bearing member 75 which rotates in and forms a bearing with 76 at 108 via screwed ring bearing holder 79 which is secured in position on rotor 47 by screwed lock ring 80. Tungsten carbide bearing member 75 is located on 86 as already described being locked by lock ring 89 on thread 85 on to rotor 47. Tungsten carbide bearing member 138 being a slide fit 92 is secured on to a shaft 93 by shaft head 136 and held against face 137 of member 135 being locked by nut 96 on thread 94 and secured by Allen screw 95. Shaft 93 being a slide fit into member 135. Member 135 is located into member 51 and secured by member 98 and thread 97 which compresses members 135 and member 68 via tungsten carbide bearing 76 against the cylindrical housing 69 and via 69 against outer case member 51, see FIGS. 4 and 5. Tungsten carbide bearing member 90 is shrink fitted into rotor 47 at 91, bearing lubricant being supplied at 134 to lubricate the cylindrical rotatable bearings faces at 84. Exhaust fluid flow 74 enters cylindrical fluid chamber 72 and then passes through holes 131 into conical bore 132 and into tube 99 and so to the drill bit, see FIG. 5. Member 98 locates on the outside diameter of drill shaft 111 and transmits drive torque through drive pin 104; members 98 and 111 are secured together by member 103 and locked by lock ring 102. Tube member 99 is sealed by laminated piston seal 100 against packer 101 to separate the exhaust mud pressure at 132 from the mud pressure between the inside of the drill shaft 111 and the outside of tube 99 at 1.

Referring now to FIGS. 1,2, and 3, full fluid flow and pressure is freely available at 4 between outer casing 2 and motor case 51, a multiplicity of motor inlet ports 123 and 130 which revolve with the motor housing provide easy access into the motor. The inlet port mud on entering the motor must simultaneously direct its flow and pressure against the radially extended driving rollers 115 to cause rotation, and also against the retracted sealing rollers 115 still totally embodied in slots 116. The cylindrical rotor 47 embodies a plurality of equally spaced slots 116 around its circumference, which slots are carefully positioned off the centre line or rotor 47 at 122, FIG. 1, ensuring that the leading faces 124 of slots 116, part of rotor 47, lean into the direction of rotation while the inserts 143 shown on FIG. 2 have faces 124 and 145 which lean clockwise in the direction of rotation and also anti-clockwise. Each slot 116 embodies a lateral clearance between its sides and its embodied rollers of probably 1 millimeter. Fluid flow and pressure passing through inlet ports 123 and 130 is, as required, partially directed via longitudinally spaced hydraulic fluid directing recesses 127 which have their bottom surfaces extending obliquely into the cylindrical rotors trailing slot face to lead said fluid into the trailing side of slot 116 via a rotor to roller 115 clearance gap 140 FIGS. 1 and 2, to force said embodied rollers 115 against the leading slot faces 124 while they are still retracted, fluid flow and pressure causing said rollers to leave their retracted positions and to roll radially outwards towards the periphery of the angled leading faces 124 which angled leading faces 124 of slots 116 causes radially extended rollers 115 to lift the centre lines at 125 completely above the periphery of rotor 47 to expose the underbelly of the extended roller 115 to high velocity fluid flow and pressure 114, the underbelly fluid pressure at 114 against rollers 115 being of greater surface magnitude than fluid pressure 126 above the centre line 125 of roller 115 coupled with the differential pressure between the inlet mud and the exhaust mud, acts to cause positive wear-compensating rolling and sealing between the internal periphery 73 of housing 69 and positive sliding sealing between the leaning angled leading face 124 and so cause rotation, torque, and horsepower to be generated.

As the fluid pressure driven rolling rollers 115 reach the exhaust ports 128 the fluid flow and pressure 114 which has caused rotation is released into exhaust via passages 74 which are cut into and rotate with housing member 69 and connect to revolving members 135 and 98 with hollow centre 132 and the revolving drill shaft 111. Concurrently with this fluid pressure release and pressure drop, the extended, but no longer driven rollers 115 change from the driving side 124 of the axially extended rotor slots 116 to the double angled trailing side 129 of the same slot, FIG. 2, which configuration contains fluid direction recesses 127 and readily facilitates the rollers access into said slot as the rollers are forced by the internal profile 141 of the cylindrical housing 69 to retract and return into their axial embodying slots 116; this side changing action of the rollers necessitates that much of the mud or fluid under the rollers must and can only be exhausted gradually and radially in front of the rollers through the lateral exhaust clearance 133 as the rollers sink into their slots 116 and displace mud or fluid to exhaust 128. Consequently it is vital to roller motor design that the exhaust ports must be radially extended, preferably to allow two or more rollers to be passing through and exhausting into the same exhaust port simultaneously to allow for the small under roller volume of incompressible fluid to be exhausted, otherwise the motor suffers from a solid hydraulic braking effect and will fail completely to revolve.

As the exhausting rollers 115 pass over the exhaust ports 128 at 141 into the smallest concentric sealing periphery 142 of the internally recessed and profiled housing 69 the rolling rollers 115 embodied in slots 116 of rotor 47 will exhaust only and precisely that volume of mud or fluid embodied in slot 116 and under the rollers 115 which is necessary to allow the rollers 115 access into the smallest periphery 142 and no more. This ensures that the rollers are held and supported in rolling and sealing contact at 142 and 145 FIG. 2, by a cushion of high pressure mud fluid present underneath the rollers at 113; this underroller pressure 113 is increased by the rolling advance of the rollers towards the inlet ports and the pressure out of balance due to the pressure drop differential between inlet port and exhaust which holds rollers 115 firmly against the trailing face 129 at point 145 of slots 116 part of rotor 47 and the internal profile 142 of housing 69. As the periphery of the rotor 47 passes the inlet port the incoming fluid is intermittantly re-directed and caused to impinge against a roller which is forced to rise and move radially away from the motor'axis.

The motor described in this invention has been entirely engineered to operate in temperatures of perhaps 200° Centigrade, while being driven by mud or fluid which will even if centrifuged, embody in its flow particles of abrasive substance. As a consequence of this, the internally profiled housing has been engineered and a manufacturing method created to electro-chemically machine the internal recesses and profile, together with its inlet and exhaust ports from wear-resistant materials such as Stellite 20 or tungsten carbide, both of which materials can readily and easily be accurately and quickly shaped and profiled by this modern method of machining these extremely hard and wear-resistant materials. The roller would also be made in a wear-resistant material such as Stellite 20, but preferably in tungsten carbide and this also applies to the contact sides of the roller confined slots see FIG. 2 which shows an enlarged part section of the external rotor 47 showing four embodied rollers 115, one roller being in the seal position and completely retracted in slot 116, where the embodied roller 115 is in sealing contact at point 145 on face 129, part of insert 143 and also in contact with the internal housing 69 at 142 being supported by mud pressure 113 to cuse the parallelogram of forces indicated on rollers 115 to have one of its longer sides in contact with the lower exhaust pressure at 144, and the other longer side in contact with the higher pressure at 113 to cause rolling sealing contact between the retracted roller 115 and the internally recessed housing 69 at 142 and the external rotor 47 sealing point at 145. The fluid pressure embodied in slots 116 at 113 being exerted against face 129 and point 145 through roller 115 is also being equally exerted against the co-relating side of slot 116 at 124 and these forces are and must always be, in balance and cancel themselves out. They have no effect in either direction.

FIG. 2 also shows a similar parallelogram of forces on the extended driven driving rollers 115, to those described above, but these forces act to keep the extended driven rollers 115 in very firm rolling contact with housing 69 at 73 and in contact with face 124 to cause rotation and this has already been adequately described. The thrid roller 115 on FIG. 2 is shown exhausting mud or fluid flow at 113 from underneath the roller 115 as it is forced by the internal exhaust station periphery 141 of housing 69 to return to its retracted sealing position in slot 116. The fourth roller is shown immediately radially passed the inlet port having been forced to change from the trailing side of slot 116 to the leading side 129 by incoming inlet fluid at 140 and rise outwardly into contact with housing 69 at 73.

Referring again to FIG. 2 the roller shown immediately past the inlet port is now in the driving station having been forced to change from the trailing side of its slot, shown on FIG. 2 adjacent the exhaust 141, to the leading slot side of the same slot as it passes through the incoming inlet port fluid pressure which incoming fluid mainly enters the motor on the negative side of its axis between the rotors in the space defined as running clearance or gap, that is to say, mainly in the least concentric internal profile of the housing as shown on FIG. 1 to cause the retracted rollers to be pressurized as they pass through the incoming fluid flow against the leading slot face as shown on FIGS. 1 and 2 and the adjacent profile of the housing causing the roller to block the fluid flow between inlet and exhaust forces the fluid to use its pressure to cause rotation, torque and horsepower to be generated.

Figure 6:
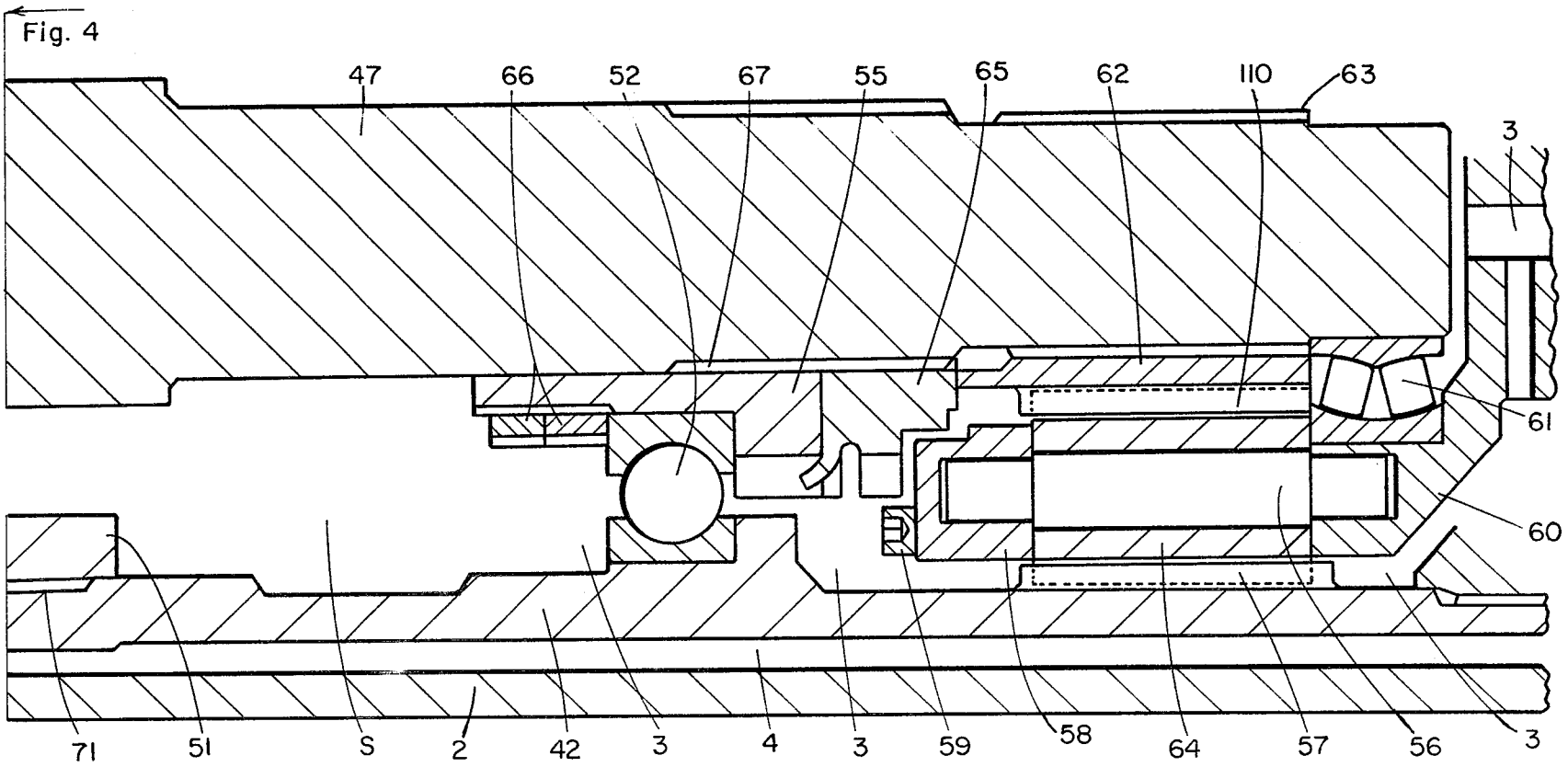
FIG. 6 shows a quarter sectioned view of a speed reducing gear box.

FIG. 6 shows a planetary gear box wherein the anti-clockwise rotation of rotor 47 is converted into clockwise rotation via the spline 63 and the meshing teeth of sun gear 62 with pinion gear 64 at 110 and via the meshing teeth of pinion gear 64 with the teeth cut into member 42 shown at 57, member 42 being secured to member 51 by thread 71. The thrust bearing assembly consists of locking rings 66 which secure bearing 52 on to member 55 which member is screwed and secured to rotor shaft 47 by screwed locking member 65. The sun gear 62 is splined to locate on rotor shaft 47. Bearing 61 locates via pinion shaft holder 60, the pinion bearing shafts 56 on which pinion 64 revolves. The pinions are supported and loosely secured on to shaft 56 by ring member 58 and dowel screws 59, the pinion shaft assembly on member 60 does not revolve. "S" is space left for sealing means, 3 is lubrication within the gear box systems. High pressure fluid passing between the outer case 2 and the outside of the gear box member 42 is shown at 4.

What I claim is:

1. A rotary positive displacement hydraulic motor comprising a cylindrical rotor embodying in its circumferencial periphery off rotor centre line axially extending angled slots, the trailing face of each slot embodying in its periphery one or more hydraulic fluid directing recesses which have a bottom surface extending obliquely from the rotor's periphery into the trailing face of the said angled slots, said fluid directing recesses acting in combination with the internally profiled housing's inlet ports to lead fluid pressure and flow via the trailing slot face and lateral slot to roller clearance to the under-belly of a roller lodged freely in the slot, said roller being slidably confined longitudinally but having a lateral clearance when retracted of probably one millimeter dependent entirely on the volume of fluid embodied in said slot which must be exhausted from underneath the roller as the roller is forced to retract into its slot as it passes through the exhaust phase of the working cycle, said rotor and rollers being mounted for free axial rotation into an internally recessed and concentrically profiled contra rotating housing, means connecting the rotor and housing together such that clockwise rotation of one will produce anti-clockwise rotation of the other, said profile being circumferentially divided into a number of equally spaced stations, each station comprising retracted sealing, fluid inlet, driving and exhaust section, inlet port fluid flow and pressure being directed at the required velocity in combination with the fluid directing recesses contained in the rotor's periphery acts to cause the retracted rollers as they pass through or almost through, the incoming inlet fluid to change from the trailing slot face to the leading slot face while still retracted causing the fluid pressure driven rollers to leave their retracted positions and to rise away from the rotor axis while remaining in constant contact with both the leading rotor slot face and the internal housing's profile and to lift their longitudinal axis above the periphery of the cylindrical rotor exposing the underbelly of the now radial extended rollers to fluid flow and pressure which holds them in their operative position in which they produce useful rotation and torque on both the rotor and profiled housing in both clockwise and anti-clockwise direction, said profiled housing embodying exhaust port means whereat the driven driving rollers change from the leading slot face to the trailing slot face acting to cause much of the fluid present under the said rollers and embodied in the external rotors axially extended slots to be exhausted through the lateral clearance gap between slots and rollers and radially in advance of the retracting rollers, said port means being radially probably as long as the pitch between any two rollers but preferably radially longer allowing two or more rollers to be exhausting into the exhaust section simultaneously as they retract into their embodying slots where they are supported in said embodying slots by an under roller cushion of high pressure mud, which mud, because of the pressure drop differential between inlet and exhaust ports, acts to hold said rollers in rolling, sliding and sealing contact between the trailing side of the rollers embodying slots and the smallest concentric periphery of the internal housing.

2. A motor as in claim 1 wherein the side faces of the axially extended roller slots are angled and arranged to increase the area of that part of the roller periphery which is exposed to the lowest pressure to create a higher pressure differential and to ensure a wear-compensating rolling seal in both driving and sealing positions.

3. A motor as in claim 1 wherein a plurality of radial exhaust ports are spaced longitudinally along the length of, and rotate with, the internally profiled and recessed motor housing and have access into axially extending slots positioned in the rotating motor's outer case, said slots extending the entire length of the motor and connecting into the hollow centre of a drill shaft.

4. A motor as in claim 1 wherein a plurality of inlet ports which revolve with the motor housing are spaced longitudinally along the length of the internally profiled and recessed housing and act in combination with the longitudinally spaced bottom oblique faces of the recesses embodied in the periphery of the cylindrical rotor to lead high pressure mud fluid to the under-belly of the still retracted rollers and to pressurize said rollers and force them to change from the trailing slot face to the leading slot face while still retracted as they pass through the incoming inlet fluid flow.

5. A motor as in claim 1 wherein the external rotor of a hydraulic motor embodies off centre line angled slots, the trailing faces of each of the said slots embodying two differently inclined angles of which the radially outer angle is arranged to readily facilitate roller access into said slots during the exhaust cycle and increase the length and so the operational time factor of the fluid directing recess, the other angle being designed to increase the roller area of that part of a parallelogram which is exposed on the one side to the lower mud fluid pressure while the opposite side is exposed to the higher pressure which fluid pressure promotes rolling sealing contact between the smallest periphery of the internal housing and the retracted roller embodied and in sealing contact with the axially extending slots of the external rotor.

6. The motor described in claim 1 has its wear parts manufactured in abrasion resistant material wherein the internally profiled and recessed contours together with the inlet and exhaust ports of the motor housing are either electro chemically machined or electrically spark eroded or precision cast to size.

7. A motor as in claim 1 wherein said hydraulic positive displacement concentric constant speed roller driven motor has its internal profiled housing and its cylindrical rotor connected together by a planetary reduction gear box wherein the anti-clockwise rotation of either the internal housing or the external rotor are converted into clockwise rotation and wherein the power generated in the anti-clockwise rotating member is added to power generated in the clockwise member.

8. A motor as in claim 1 wherein a hydraulic motor has a plurality of rollers which are loosely embodied in the axially extending external rotor slots wherein the retracted rollers are, as their centres pass through the incoming inlet mud flow, pressurized against the rotor's leading slot face while still in a retracted position, allowing the incoming inlet mud or fluid to freely pass over their pressurized, retracted outside diameters allowing said mud or fluid to flow and impinge against the radially forward extended rollers to cause rotation.

9. A motor as in claim 1 wherein a hydraulic motor has contra rotating rotors, the cylindrical rotor embodying rollers which are, when the motor is operating, always forced by fluid flow and pressure into continual and positive rolling contact with the internal profile of the housing and also with either the trailing or leading side faces of its embodying slot without the aid of mechanical springs, said contra rotating rotor having a concentric free running clearance or gap between their revolving rotors, having a constant fluid capacity between the least and largest concentric housing profiles which form identical motor fluid pressure chambers there between each and every inlet and exhaust port, causing said motor to develop a constant velocity of clockwise and anti-clockwise rotation in its rotating rotors and to generate torque and horsepower.

10. A motor as in claim 1 wherein the unpressurized cylindrical rotor and the internally profiled housing of a positive displacement hydraulic rotary motor which in operation is vertical or nearly so, being entirely without the aid of gravity, or underneath roller springs, or centrifugal forces as a means to force the unpressurized and retracted slot embodied rollers outwards into contact with the internal periphery of the housing rotors, leave a clear and open fluid mud passage between the inlet and exhaust port, wherein the slot embodied rollers must be forced out of their emboding slots by fluid flow and pressure and into sealing engagement with the internally profiled housing before rotation can start.

11. A motor as in claim 1 wherein the unpressurized contra-rotating rotors of a rotary positive displacement hydraulic roller motor are caused to rotate by high pressure fluid flow through inlet ports which revolve with the internally cylindrical housing, which incoming fluid flow mainly enters the motor between the rotors in the space defined as running clearance or gap, that is mainly in the least concentric cylindrical profile of the housing, to cause the retracted rollers to be pressurized as they pass through the incoming inlet fluid flow against the leading slot face of the cylindrical rotor and the adjacent profile of the housing causing the rollers to block the fluid flow between inlet and exhaust ports and by extracting pressure from the fluid causing rotation, torque and horse power to be generated.

12. A motor as in claim 1 wherein the cylindrical rotor of a hydraulic motor has axially extending off center line angled slots wherein the periphery of said rotor contains fluid directing recesses which have obliqely angled bottom surfaces, these surfaces extend from the rotor's periphery into the trailing side face of the said axially extending slots and increase that minute period of operational time wherein the inlet port incoming fluid is directed to and against the underbelly of a rising roller lodged freely in said slot.

13. A motor as in claim 1 wherein the high pressure incoming fluid of a positive displacement hydraulic motor is present beyond the entire external length and external circumference of the hydraulic motor, the fluid being confined between the internal diameter of the tool's outer case and the entire external diameter of the motor case wherein said fluid has access into the motor through a multiplicity of inlet ports which rotate with the housing, these inlet ports being radially and longitudinally spaced along the entire motor rotor's length and circumference and being separated from the exhaust fluid diametrically by the thickness of the motor's outer case.

14. A motor as in claim 1 wherein the exhausted fluid having caused rotation passes out of a multiplicity of ports into two or more longitudinally radially spaced passages, which passage, being confined between the profiled housing's external diameter and the inside diameter of the motor's outer case, rotate with the motor being separate from the inlet motor fluid by the thickness of the outer motor casing, said passages extending the entire motor rotors length, being directly connected with the hollow centre of a tool's drill shaft.

15. A rotary positive displacement hydraulic motor has a plurality of rollers which are embodied in the axially extending slots of a cylindrical rotor each roller having a lateral clearance of perhaps one millimeter within its embodying slot while being slidably constrained longitudinally, said cylindrical rotor together with its embodied rollers being assembled for rotation without any mechanical springs within an internally profiled contra rotating housing, means connecting the rotor and housing together such that clockwise rotation of one will produce anti-clockwise rotation of the other, said rotor and housing having a free running clearance, the concentric internal housing profile having a constant fluid capacity and flow between its inlet and exhaust ports causes said motor to develop a constant velocity of rotation of both the internal housing and the cylindrical rotor in a clockwise and anti-clockwise direction, within this assembly the embodied rollers are floated by mud or fluid flow and pressure only from the trailing side faces of said slots to the leading side slot faces and back from the leading slot faces to the trailing slot faces as they pass through the retracted sealing, fluid inlet, driving and exhaust, internal housing stations wherein said rollers are floated on and supported by mud or fluid to their least retracted concentric sealing stations between the exhaust and inlet ports and wherein said rollers as they pass through the incoming inlet port mud or fluid flow are floated outwards into sealing rolling contact with the largest internal concentric contour of the internal housing wherein said rollers being supported by mud or fluid flow and pressure only, create a seal condition between the leading slot face and the largest internal housing concentric profile separating the inlet and exhaust ports causing the mud or fluid to exert pressure against the internal housing profile and the extended rollers to cause rotation of both the internal housing and the cylindrical rotor in a clockwise and anti-clockwise direction and to generate torque and horse power.

16. A motor as in claim 15 wherein the inlet fluid flow of a rotary positive displacement hydraulic roller motor is re-directed and has its flow course intermittently changed from the negative or trailing side of the motor's axis to the positive or leading side of the motor axis after it has passed through the internally profiled housing's inlet port as said fluid flow comes into contact with and is caused to flow along the bottom obliquely angled surface of the fluid directing recess which recess being contained in the trailing slot side of the cylindrical rotor's periphery, causes said fluid flow to be redirected around and against the underbelly of a roller rising radially outwards while said roller is firmly pressed by said fluid into sealing and rolling contact with both the leading slot face of the cylindrical rotor and the internal periphery of the housing.

* * * * *